US006130412A

United States Patent [19]

Sizemore

[11] Patent Number: 6,130,412

[45] Date of Patent: Oct. 10, 2000

[54] METHOD AND APPARATUS FOR REMOTELY CONTROLLING DEVICES IN RESPONSE TO A DETECTED ENVIRONMENTAL CONDITION

[75] Inventor: Charles Timothy Sizemore, Middletown, Ohio

[73] Assignee: SSM Technologies, Middletown, Ohio

[21] Appl. No.: 09/231,499

[22] Filed: Jan. 14, 1999

[51] Int. Cl.[7] ..... H05B 1/02

[52] U.S. Cl. ..... 219/481; 219/497; 219/494; 219/414; 219/506; 219/483; 340/825.72

[58] Field of Search ..... 219/501, 506, 219/411–414, 481, 497, 486, 494, 483; 340/825.72, 825.69; 392/365–369, 373, 374

[56] References Cited

U.S. PATENT DOCUMENTS

| | | | |
|---|---|---|---|
| 4,659,909 | 4/1987 | Knutson . | |
| 4,930,488 | 6/1990 | Pearman et al. . | |
| 5,023,601 | 6/1991 | McGannon . | |
| 5,189,392 | 2/1993 | Kass et al. . | |
| 5,321,229 | 6/1994 | Holling et al. | 219/448 |
| 5,489,889 | 2/1996 | Kambouris et al. . | |
| 5,552,775 | 9/1996 | Harley . | |
| 5,625,345 | 4/1997 | Starketal . | |
| 5,670,074 | 9/1997 | Kass et al. . | |
| 5,951,900 | 9/1999 | Smrke | 219/497 |

*Primary Examiner*—Mark Paschall
*Attorney, Agent, or Firm*—Snell & Wilmer LLP; Lee G. Meyer, Esq.

[57] ABSTRACT

A method is disclosed for detecting a condition indicative of fire or elevated potential for fire, broadcasting a signal in response to its detection and for operating various controlling devices in response to the broadcast signal in order to enable or disable valves or appliances connected to a power supply through the controllers. Also disclosed is a system having a sensor, a transmitter responsive to the sensor, a receiver for receiving signals from the transmitter and controllers responsive to a signal from the receiver for controlling devices in accordance with the method of the invention. Each of the controllers is shifted from its normal position to a second position upon the receipt of a signal from any one of the sensors, and more than one controller device may be controlled by a given receiver. Multiple sensors, each capable of detecting a different condition, indicative of fire or elevated potential for fire such as the presence of smoke or strong vibration, can be used in a single system for activating all the controller devices upon the detection of a condition indicative of fire or elevated potential for fire.

28 Claims, 2 Drawing Sheets

METHOD AND APPARATUS FOR REMOTELY CONTROLLING DEVICES IN RESPONSE TO A DETECTED ENVIRONMENTAL CONDITION

BACKGROUND OF INVENTION

1. Field of the Invention

This invention relates to a control system for selectively activating or deactivating a device in response to a detected condition; and, more particularly to a method and apparatus for detecting a predetermined environmental condition and remotely activating or deactivating one or more devices in response to the condition.

2. Background Art

Furnaces, space heaters, stoves and other devices, when not used or maintained properly, can cause fires. Even when used in a proper manner, unforeseen events, such as catastrophic device failure, electrical shorts, earthquakes, tornadoes and hurricanes may interfere with the proper operation of these devices and cause them to start fires. In addition, if a gas line ruptures during a fire or natural disaster, the leaking gas may contribute to the spread of a fire or, in the presence of a spark, cause an explosion. If no one is present when a fire starts, it may spread quickly and cause significant damage. When persons are present, their attention is likely to be focused on maintaining their own safety, and not on turning off gas lines, electrical circuits, and devices such as appliances. Likewise, in the event of a natural disaster, people are likely to be concerned with their immediate safety and not consider the damage that could be caused by a ruptured gas line or an unattended stove.

Smoke detectors and similar detection devices for detecting and signaling danger such as providing warning after a fire has started are well known, but do nothing to minimize the event detected or mitigate the result of the event. For example, if a fire reaches a gas line leading to a stove, the gas in the line could ignite or explode and aggravate the fire. Attempts have been made to equip potential fire sources such as furnaces and stoves with their own smoke detectors, and to shut off gas or power when that smoke detector sounds. One such system is shown in U.S. Pat. No. 5,670,074 to Kass, wherein various smoke and gas detectors are directly connected to a furnace in order to shut the furnace off if it catches fire, leaks fuel or exhaust gases. However, these detectors will not detect an independent event which is remote from the furnace. Similarly, U.S. Pat. No. 4,659,909 to Knutson, shows an electric range having its own smoke detector and a controller for interrupting power to the range when the smoke detector sounds. Again, this arrangement does nothing to prevent the range from contributing to a fire started elsewhere in a building, nor will it shut off the range in the event of a natural disaster. Further, in many retrofit situations hard wire of the detector and the appliance may not be possible. It would therefore be desirable to provide a safety system for activating deterrents and/or deactivating devices or disconnecting power and gas supplies when a natural disaster occurs or when a fire starts even remotely from the device to be activated or deactivated such that the detector and the device may be remote one from the other and not require a hard wire connection.

Accordingly, it as an object of the present invention to provide a shut-off system which can overcome the above noted defects inherent in the previously known systems.

It would therefore be advantageous to have a system to detect the presence of smoke, vibrations, or other dangerous and anomalous environmental conditions in any area where the detector is placed and cause the shut-off/or activation of any device which may be a possible contributing factor to a fire/overheating, or other dangerous situation. It further would be advantageous to provide a system whereby receivers for activating controllers could be placed on any device in the home, office or other location to provide a wireless system between the environmental detector and the remote transmission receivers which are attached to the devices which are to be shut-off. It would also be advantageous to provide detection and device shut-off for the occurrence of a multitude of dangerous conditions.

Additional objects and advantages of the present invention will become apparent from reading of the detailed description of the preferred embodiments.

SUMMARY OF THE INVENTION

It has now been discovered that various, heretofore unsolved problems, are solved by the present invention of a remote sensor, for detecting one or more predetermined environmental conditions, communicating with a transmitter for transmitting a signal in response to the detection of one or more predetermined environmental conditions; and, receiving controllers for enabling or disabling various devices in response to signals sent by the sensor activated transmitter. A method is also provided for using the remote sensor in cooperation with the controller for enabling or disabling various devices in response to certain detected conditions in order to mitigate the damage that could potentially occur after one of the selected conditions is detected.

In accordance with the broad aspect of the invention at least one sensor, relatively remote from the device to be activated or deactivated, is conditioned to respond to one or more predetermined environmental conditions. The at least one sensor communicates with a transmitter to transmit one or more predetermined transmitter activating signals in response to the at least one sensor. At least one receiver, in controlling communication for activation or deactivation of the device, for responding to one or more predetermined receiver activating signals from said transmitter to activate or deactivate the device. In accordance with a preferred embodiment, the invention comprises a remotely located smoke detector in responsive communication with a transmitter for broadcasting a transmitter activating signal when smoke is detected by the smoke detector, and a receiver, proximate a device, adapted to activate or deactivate at least one device in response to the receiver activating signal. Thus, when smoke is remotely detected, the controllers could activate for example, electronic gas shut off valves to prevent the possible escape of gas that could feed the fire, and also disable all heat-producing devices connected to the system which could be possible sources of the fire. If food burning in an electric toaster catches fire, for example, not only would that toaster oven be disconnected from its source of power, but gas to the nearby kitchen stove would be disconnected as well to minimize the danger of an explosion.

In another aspect, the system includes at least one sensor for detecting strong vibration which would indicate an earthquake or a tornado. Preferably the sensor would only detect vibrations of a predetermined nature, such as those indicating imminent damage to a structure, and not merely those caused by persons walking or slamming doors. Persons fleeing a building during an earthquake or seeking shelter in a basement during a tornado are unlikely to shut off an oven or turn off a space heater, and these devices could easily start fires, especially if moved or tipped during the disaster. Similarly, gas lines can be damaged during natural disasters, and the presence of free flowing gas under such conditions increases the potential for fire. In another aspect sensors can be programmed in combination such as smoke, motion, and other sensors such that a single sensor response will not signal a controller to activate or deactivate a device. In this manner only a set of concurrent events or sequenced events would trigger a response.

In accordance with another embodiment, a plurality of individual sensors, such as smoke detectors could be located strategically about an edifice, such as a dwelling, to respond in a similar manner to disturbances in various locals within the structure. Thus, these separate sensors can be used in a system to provide increased protection for a building. While these sensors may be spread throughout a building, the activation of any one sensor will shut off all gas lines and heat-producing electrical appliances connected to the system, including those that are not proximate to the activated sensor. In this manner, sources likely to have caused the smoke, or which would increase the potential of fire, are all deactivated no matter the location of the disturbance responded to. The number of sensors is independent of the number of receivers, and therefore the system can be modified by adding, removing or repositioning sensors, or by adding, removing, or repositioning additional receiving controllers for protecting additional devices without affecting the operation of the rest of the system. In addition, a particular receiver can be used to control multiple devices, and this is especially useful when several devices to be controlled are located in close proximity to one another.

Beneficially, the controllers of the present invention operate remotely, and can be used in existing buildings without any need for rewiring. This may be especially useful in rental properties where a person may not be allowed to modify the electrical systems. In addition, the sensors and controllers are relatively portable, and may be installed in a dwelling that will only be occupied for a short time, then removed and taken to a new location. This would be difficult or impossible to do with hard-wired systems.

BRIEF DESCRIPTION OF THE DRAWINGS

These and other objects of the invention will become apparent from a reading and understanding of the following detailed description of several preferred embodiments of the invention together with the following drawings of which.

DETAILED DESCRIPTION OF THE PREFERRED EMBODIMENT

Figure 1:
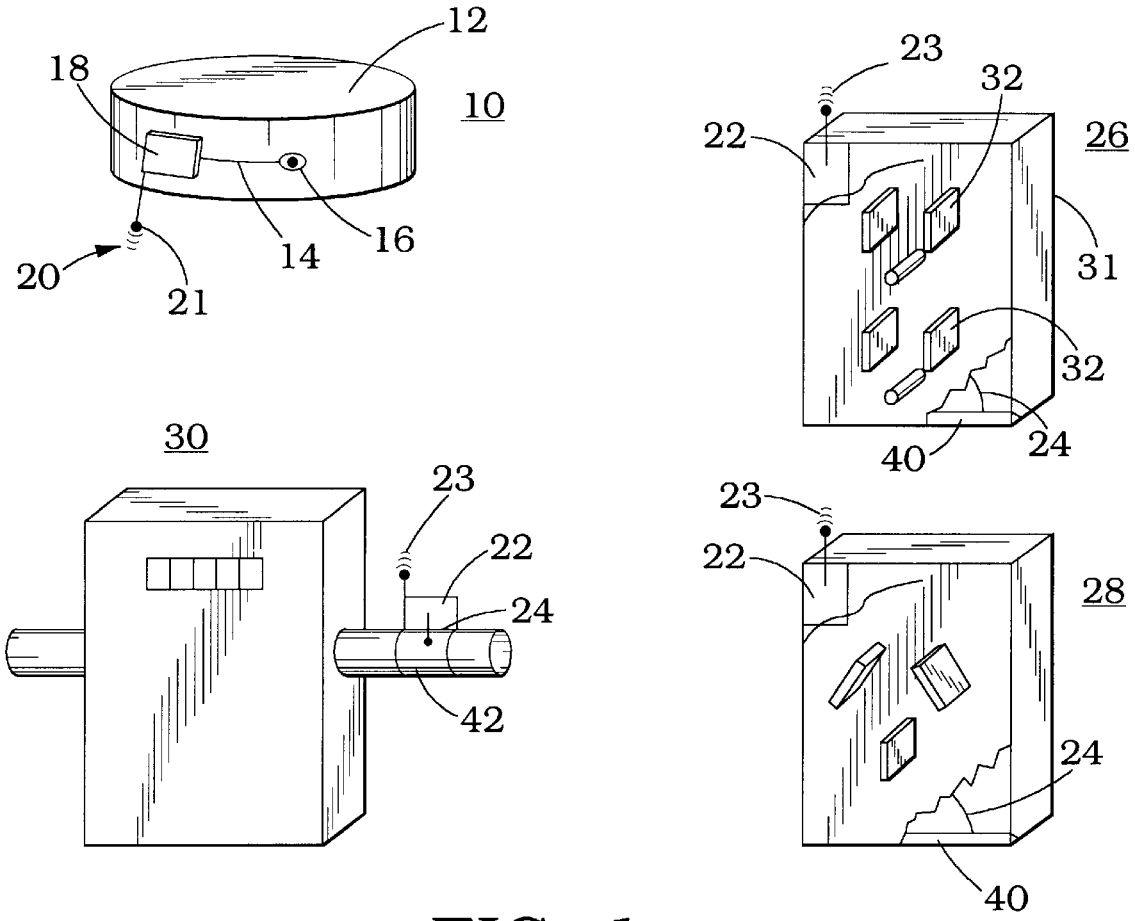
FIG. 1 is perspective view schematically showing the arrangement of elements in a first embodiment of the subject invention.

Referring now to the drawings, wherein the showings are for the purpose of illustrating several preferred embodiments of the subject invention only, and not for the purpose of limiting same wherein like elements are similarly numbered, FIG. 1 shows a safety system 10 including a sensor 12 that produces a transmitter activating signal 14 at output 16 when a predetermined condition is detected. In a preferred embodiment, sensor 12 is a smoke detector and produces response transmitter activating signal 14 in response to the presence of smoke. An example of a smoke detector that produces a transmitter activating signal 14 that can be used in practicing the subject invention is the "Lifesaver Smoke Alarm" (Model 1255) manufactured by South West Laboratories, Inc. While this smoke detector operates off standard house current, a battery is preferably used as a backup power source. A sensor powered solely by battery power could also be used.

A transmitter 18 communicates with sensor output 16 which produces a transmitter activating signal 14 transmits a receiver activating signal 20 by means of antenna 21, remotely to a receiver 22 by way of receiving antenna 23. As shown in FIG. 1, receiver 22 can comprise one or a plurality of devices. Receiver activating signal 20 is preferably a radio frequency signal, but other types of signals, such as infrared or ultrasonic may be generated in addition to, or instead of a radio frequency signal under various circumstances. The system includes a plurality of receivers 22 that generate a controller activating signal 24 in response to receipt of the receiver activating signal 20, and this controller activating signal 24 can be sent to various controlling devices 26, 28, and 30 which are operatively connected to appliances, valve controls, or other devices which are to be controlled by the smoke detector. The controllers are designed to shift position from a first, normal, position to a second, emergency, position upon the receipt of the controller activating signal 24. For appliances such as space heaters, electric ranges, and for gas valves leading to ovens, water heaters or furnaces, the controlling devices are normally in the "on" position and will shift into the "off" position to turn off these valves or appliances when controller activating signal 24 is received. Controllers can also be used that are normally in an "off" position that are shifted to an "on" position, upon the receipt of controller activating signal 24, in order to activate devices that should be in operation during an emergency, such as alarms, emergency lighting or automatic phone dialers for calling the owner of the building or a security service.

While FIG. 1 depicts only one sensor 12, it will be understood by the skilled artisan that more than one such sensor may be used to provide protection for an office or dwelling. Each of the transmitters 18 that communicate with these sensors 12 is capable of sending a receiver activating signal 20 to one or more receivers 22 so that all gas valves and appliances connected to the system will be deactivated upon the receipt of that signal and/or all emergency devices will be activated such as a fire retardant device. In this manner, for example, a gas range that was not involved in the initiation of the fire will not contribute to the fire if the fire spreads to the vicinity of the range and damages the range, its gas and its gas connections.

Figure 2:
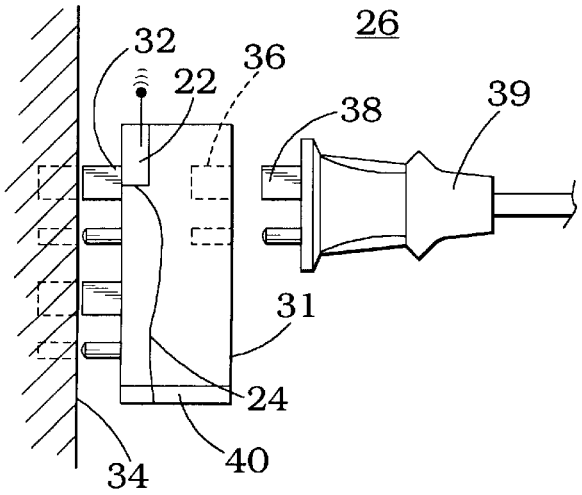
FIG. 2 is a side elevational view of one of the controller elements used in the system shown in FIG. 1; and, FIG. 3 is a perspective view schematically showing the arrangement of elements in a second preferred embodiment of the subject invention wherein a single receiver/controller is used to control a plurality of different devices.

In accordance with the invention a first type of controller device 26, as better shown in FIG. 2, comprises a housing 31 including standard electrical prongs 32 that can be plugged into a standard 110 volt electrical outlet 34. Housing 31 further includes openings 36 for receiving the prongs 38 of an electrical plug 39 such as from a space heater (not shown). The housing 31 also contains a receiver 22 for receiving the receiver activation signals 20 from transmitter 18 and a circuit breaker 40 for preventing the flow of current through device 26 when a receiver activating signal 20 is received from the transmitter 18. In the event of a false alarm, or after a dangerous situation is over, the circuit breaker 40 can be readily reset so that the system can continue to operate. This may be accomplished by using a reset controller on the receiver 22 itself, or by pushing a reset button on the transmitter 18 to send a reset signal for resetting all devices in the system at once (not shown). Controller device 28, shown in FIG. 1 is similar to device 26 and operates in a similar manner, but is intended for use with a 220 volt appliances such as electric stoves.

Controller device 30, depicted in FIG. 1, operates in a similar manner and is a standard controller for an electrically controlled gas or water valve 42. Controller activating signal 24 generated by receiver 22 of device 30 is used as an input into the controller 30 in order to operate valve 42. Various modifications of controllers and controllers activated by signals from receivers 22 could also be used without exceeding the scope of this invention. Furthermore, sensor 12 could comprise any type of sensor, such as a toxic gas detector or a vibration detector for shutting down gas lines and appliances in the event of a gas leak or earthquake.

Figure 3:
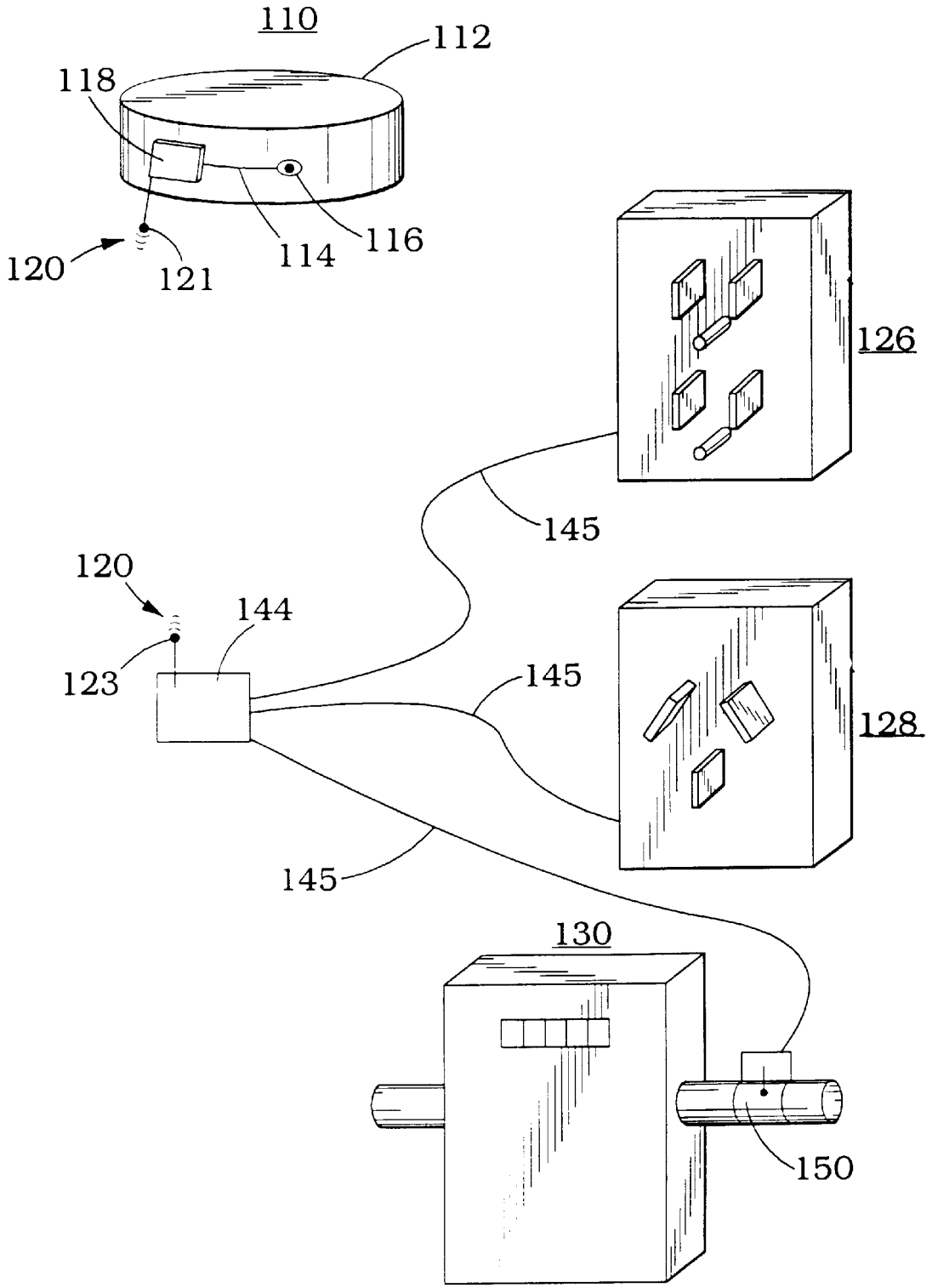

Turning to FIG. 3, there is shown a second embodiment of the subject invention 110 wherein a single receiver 144 is operatively connected to a number of devices which need to be controlled. In this embodiment a single controller may be connected such as with hard wire 145 to a number of devices. As shown in FIG. 3, a system 110 includes a receiver 144 hard wired via wires 145 to a plurality of controllers which may be the same, or as shown in FIG. 3, may be different controller devices 126, 128, 130 located remotely from the receiver 144. As will be seen, controller 126 corresponds to controller 26 in FIG. 1, controller 128 corresponds to controller 28 in FIG. 1, and controller 130 corresponds to controller 30 in FIG. 1. The system of this embodiment operates in the same manner as that of the first embodiment, however, fewer receivers are used. This may be beneficial in situations where several devices that are being controlled are located in close proximity to one another, such as gas and water valves in a basement of a house, but are designed to be collectively responsive to a single signal. Receiver 144 can be controlled by the same receiver activating signal used for controlling receivers 22 in the first embodiment, and therefore, systems can be developed that include a combination of receivers 144 and receivers 22. It will be understood that "activation" and/or "enabling" includes "deactivation" and/or "disabling" in accordance with this invention.

The present invention has been described in terms of several preferred embodiments, it being understood that additions and modifications to this system will become apparent to those skilled in the relevant art upon a reading and understanding of the foregoing description. For example, a wide variety of devices could be controlled using the method and system described or obvious modifications thereof, and the sensors and receivers can be configured in many different ways in order to provide optimal protection for a building. It is applicant's intent that all such obvious modifications and additions be included within the scope of this application to the extent that they are covered by the several claims appended hereto.

What is claimed is:

1. A system for controlling devices comprising:

at least one sensor for sensing a predetermined environmental condition and generating a transmitter activating signal in response to the detection of said condition;

at least one transmitter in communication with said at least one sensor, said transmitter broadcasting a receiver activating signal in response to receipt of said transmitter activating signal from said at least one sensor;

at least one receiver, located remotely from said transmitter, capable of detecting said receiver activating signal and generating, in response to receipt of said signal receiver activating signal, a controller activating signal;

at least one controller in communication with said device for activating/deactivating said device in response to said controller activating signal.

2. The system of claim 1 wherein said at least one receiver comprises a plurality of receivers.

3. The system of claim 1 wherein said at least one receiver communicates with a plurality of controllers.

4. The system of claim 3 wherein said communication is accomplished by hard wires.

5. The system of claim 1 wherein said at least one sensor comprises a plurality of sensors.

6. The system of claim 1 wherein a first one of said plurality of sensors detects a first environmental condition and a second one of said plurality of sensors detects a second environmental condition.

7. The system of claim 6 wherein said first sensor senses the presence of smoke.

8. The system of claim 6 wherein said first sensor senses the presence of vibration.

9. The system of claim 6 wherein said first sensor senses the presence of smoke and the second sensor senses the presence of vibration.

10. The system of claim 1 wherein said at least one sensor simultaneously activates/deactivates a plurality of devices.

11. The system of claim 1 wherein said at least one controller comprises a plurality of controllers operatively connected to one of said plurality of receivers.

12. The system of claim 11 wherein said at least one controller comprises a plurality of controllers, at least one of said plurality of controllers being operatively connected to a first one of said plurality of receivers, and at least a second one of said plurality of controllers being operatively connected to a second one of said plurality of receivers.

13. The system of claim 1 wherein said at least one controller is adapted to deactivate said device in response to the receipt of said signal.

14. The system of claim 1 wherein said at least one controller is adapted to activate said device in response to the receipt of said signal.

15. The system for controlling devices of claim 1 wherein said at least one controller in communication with said device activates said device in response to said controller activating signal.

16. The system for controlling devices of claim 1 wherein said at least one sensor is not proximate a controlled device.

17. A system for enabling a first set of devices and simultaneously disabling a second set of devices comprising:

a plurality of sensors, comprising at least one sensor for detecting a first environmental condition and a second sensor for detecting a second environmental condition, said first and second sensors generating a signal in response to the detection of said first or second condition;

a transmitter in communication with each one of said plurality of sensors, said transmitter broadcasting a radio frequency signal after receiving said signal from one of said plurality of sensors;

a plurality of receivers located remotely from said sensors capable of detecting said signal from any one of said plurality of transmitters and generating a signal for activating the controllers after the detection of said signal;

a first controller operatively connected to one of said plurality of receivers and being openable in response to the receipt of said controller activating signal, and a second controller operatively connected to one of said plurality of receivers and being closeable in response to the receipt of said controller activating signal.

18. A system for controlling devices comprising:

sensing means for sensing a condition indicative of fire or elevated potential for fire and generating a first signal in response to the detection of said condition;

transmitting means in communication with said sensing means for broadcasting a second signal after receiving said first signal from said sensing means;

receiver means located remotely from said transmitter means for detecting said second signal and generating a third signal after the detection of said second signal;

controller means operatively connected to said receiving means for shifting between first and second positions in response to the receipt of said third signal.

19. The system of claim 18 wherein said sensing means comprises first and second sensor means.

20. The system of claim 18 wherein said receiver means comprises a number of receivers and said controller means comprises a number of controllers.

21. The system of claim 20 wherein said number of receivers in said system is independent of the number of controllers in said system.

22. The system of claim 21 wherein said number of controllers is greater than said number of receivers.

23. The system of claim 19 wherein the said first sensing means comprises at least one sensor and said second sensing means comprises at least one sensor, and wherein the number of sensors comprising said at least one first sensor, the number of sensors comprising said at least one second sensor, and the number of receivers are mutually independent.

24. A method for enabling or disabling devices comprising the steps of:

providing a sensor for sensing the presence of a first selected condition;

broadcasting a signal in response to the detection of said selected condition;

operatively connecting selected devices to a plurality of controllers responsive to said signal; and;

enabling or disabling said devices in response to the receipt of said signal.

25. The method of claim 21 wherein the step of operatively connecting selected devices to a plurality of controllers comprises the step of operatively connecting multiple ones of said devices to at least one of said plurality of controllers.

26. The method of claim 21 including the additional step of sensing for the presence of a second selected condition and broadcasting said signal in response to the detection of said second selected condition.

27. The method of claim 21 wherein said sensor is located remotely from said devices.

28. The method of claim 26 wherein the step of enabling or disabling devices comprises the steps of enabling a first set of said devices and disabling a second set of said devices.

* * * * *